United States Patent [19]

Iseki

[11] 4,196,924

[45] Apr. 8, 1980

[54] AUTOMATIC DOOR CLOSING DEVICE

[75] Inventor: Kazuo Iseki, Tokyo, Japan

[73] Assignee: Ohta Company Limited, Tokyo, Japan

[21] Appl. No.: 927,699

[22] Filed: Jul. 24, 1978

[30] Foreign Application Priority Data

| | | | |
|---|---|---|---|
| Jul. 28, 1977 | [JP] | Japan | 52/101194[U] |
| Sep. 12, 1977 | [JP] | Japan | 52/122757[U] |
| Feb. 9, 1978 | [JP] | Japan | 53/13909 |
| Feb. 9, 1978 | [JP] | Japan | 53/13910 |

[51] Int. Cl.[2] ..... E05C 19/02

[52] U.S. Cl. ..... 292/79; 16/84; 292/DIG. 19

[58] Field of Search ..... 292/79, DIG. 12, DIG. 15, 292/DIG. 19, DIG. 36, DIG. 49; 16/82, 84; 188/317, 316; 277/31, 112, 178, 214

[56] References Cited

U.S. PATENT DOCUMENTS

| | | | |
|---|---|---|---|
| 911,074 | 2/1909 | Robinson et al. | 292/79 |
| 1,190,313 | 7/1916 | Mallory | 292/79 |
| 1,244,594 | 10/1917 | Dunn | 292/79 |
| 1,539,196 | 5/1925 | Litten | 188/316 |
| 2,148,497 | 2/1939 | Peck | 188/317 X |
| 2,309,807 | 2/1943 | Trotter | 188/317 X |
| 2,333,196 | 11/1943 | Price | 277/214 X |
| 2,595,239 | 5/1952 | Gay | 188/316 X |
| 3,023,012 | 2/1962 | Wilde | 277/31 |
| 3,053,199 | 9/1962 | Brox et al. | 188/317 X |
| 3,827,539 | 8/1974 | Fader | 188/317 X |
| 3,863,592 | 2/1975 | Borst | 188/317 X |
| 3,871,665 | 3/1975 | Burke | 277/112 X |
| 3,979,790 | 9/1976 | chiarappa | 16/84 |
| 4,048,905 | 9/1977 | Souslin | 188/316 X |

*Primary Examiner*—J. Franklin Foss

*Attorney, Agent, or Firm*—John C. Smith, Jr.

[57] ABSTRACT

An automatic door closing device includes a bell crank lever pivotablly mounted on the door which cooperates with a hook-shaped cam plate mounted on the door frame. A spring biased dash pot controls movement of the bell crank lever when the door is opened and closed, assuring that the door will close slowly but positively without slamming. Means is provided on the frame of the device to assure proper positioning of the bell crank lever with respect to the top edge of the door and the hook-shaped cam plate.

10 Claims, 8 Drawing Figures

FIG. 3
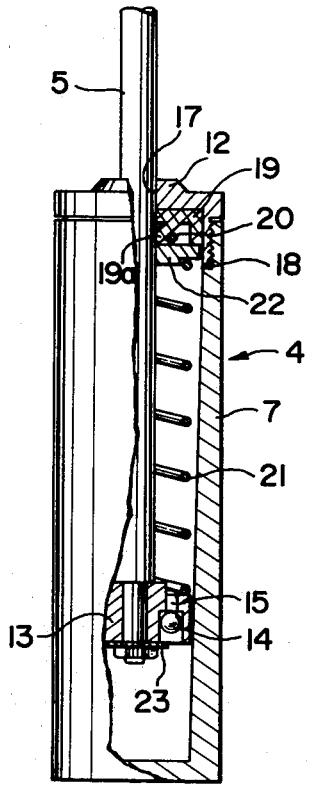
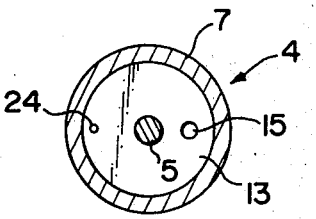
FIG. 4A
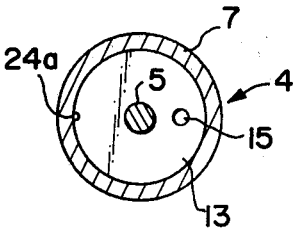
FIG. 4B
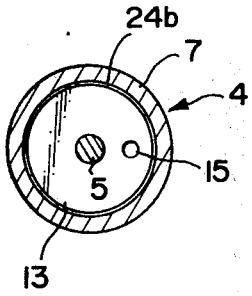
FIG. 4C

AUTOMATIC DOOR CLOSING DEVICE

BACKGROUND OF THE INVENTION

1. Field of the Invention

This invention relates to automatic door closing devices.

2. Description of the Prior Art

The present inventor has suggested a Japanese Pat. No. 30920/52 published on Aug. 11, 1977 on an automatic door closing device wherein, as shown in FIG. 1, an L-lever 3 is pivoted at one end on the short piece side with both right and left pieces as bearings 2 in the upper part of a channel-shaped fitting frame 1, a piston shaft 5 of a dash pot 4 is pivoted to the bending point 6 of the above mentioned L-lever 3, a cylinder 7 is pivoted also with both pieces of the lower part of the fitting frame 1 as a bearing 8 and a piston is pressed to one side by a spring contained in the dash pot 4 so that, when a door 9 is to be opened, by a hook plate 11 fitted to a wall frame 10, the L-lever 3 may be rotated against the above mentioned spring and may be locked when a dead point is passed and, on the other hand, when the door 9 is to be closed, just before it is closed, by the hook plate 11, the L-lever may be reversely rotated and, in case it is returned by the spring past the dead point, the dash pot 4 may be operated.

However, in this device, the prevention of oil leakage out of the dash pot 4 is made but is not perfect. During the long use, oil will leak out of the connecting part with a lid 12 screwed with the cylinder 7 or particularly the inserting part of the piston shaft 5 with the lid 12. As a result, there have been defects that the interior of the room will be stained and air will enter the cylinder 7 to fail it.

Further, in fitting such automatic door closing device to the door 9, it is screwed to the door 9 with the middle piece of the channel-shaped fitting frame 1. However, as the dash pot 4 fitted to the fitting frame 1 is in the way, it has been necessary to once remove the dash pot 4 from the fitting frame 1 and then to screw it. In fitting it, it has been necessary to fit the upper end of the fitting frame 1 to the upper end of the door 9 and to vertically position the device. Therefore, it has been very difficult to fit the device.

Further, in the conventional automatic door closing device, in the case of closing the door, a piston 13 will slide downward, a ball 14 will close a through hole 15, the passage of the oil in the cylinder 7 will be closed but, as the L-lever is gradually rotated, the oil will be leaked little by little from around the ball 14 in the structure. However, this structure requires a precision so high that it is not adapted to mass-production.

SUMMARY OF THE INVENTION

An object of the present invention is to provide an automatic door closing device which is perfect in preventing oil leakage, is simple to fit and is simple and cheap to make.

BRIEF DESCRIPTION OF THE DRAWINGS

FIG. 3 is a partly sectioned magnified side view of a dash pot.

FIG. 4A to 4C are cross-sectioned views showing embodiments of respective oil controlling devices.

DETAILED DESCRIPTION OF PREFERRED EMBODIMENTS

Figure 1:
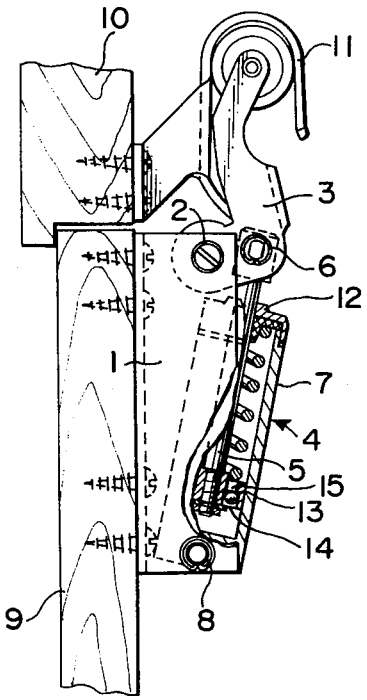
FIG. 1 is a partly sectioned side view of a conventional automatic door closing device.

1 is a channel-shaped frame screwed to a door 9. An L-lever 3 is pivoted at one end on the short piece side to this fitting frame 1. 4 is a dash pot pivoted at one end of the piston shaft 5 to the bending point 6 of the above mentioned L-lever 3. On the other hand, the dash pot 4 is pivoted at the lower end of the cylinder 7 to the above mentioned fitting frame 1 through a bearing 8. 13 is a piston screwed to the other end of the piston shaft 5 so as to move within the cylinder 7 and to be always pressed downward by a spring 21. The interior of the cylinder 7 has a proper inclination angle so that the bore diameter may be smaller downward to control the flow of oil as shown in FIG. 3 and the minimum bore diameter is of such size as enables the piston to slide through the bore so that, just before the L-lever 3 perfectly engages with a later mentioned hook plate 11, the piston 13 may enter this minimum diameter bore. Further, the piston 13 is provided with a vertical through hole 15. A ball 14 is arranged below the hole 15 to serve as a valve to form a so-called dash pot controlling the flow of contained oil. A rubber roller 16 is pivoted to the other end of the L-lever 3 and is engaged with a hook plate 11 screwed to a wall frame 13.

As shown in FIG. 3, the dash pot 4 according to the present invention consists of the cylinder 7 which is a bottomed cylinder, has such proper inclination angle as reduces the bore diameter downward and has such minimum bore diameter as enables the piston 13 to slide through the bore. A female screw is provided on the inner peripheral surface at the open end of the cylinder 7. On the other hand, a lid 12 having in the center a hole 17 through which the piston shaft 5 comes in and out is connected with the above mentioned cylinder 7 through a male screw provided on its outer peripheral surface. Said cylinder 7 and lid 12 are sealed with an O-ring 18 between them. 19 is a packing of a channel-shaped section in close contact with the inner surface and inner peripheral surface of the lid 12 and integrally provided on the inner surface with a conical tubular edge part **19*a* projected in the direction of the piston shaft 5. The piston shaft 5 is pressed by a pressing ring 20 against the outer periphery of the end part of the edge part 19*a*. By the way, a concave groove for stabilizing the pressing ring 20 may be made on the outer periphery of the edge part 19*a*. Further, 21 is a returning spring pressing at one end on the piston 13 and at the other end on the packing 19 through a washer 22. 23 is a washer supporting the ball 14**.

Another embodiment of a means of controlling the flow of oil contained within the cylinder 7 is shown in FIG. 4A. In this embodiment, the cylinder 7 has a fixed bore diameter. On the other hand, the piston 13 is provided with not only a through hole 15 but also an oil flowing passage 24 so that, even if the ball 14 perfectly closes the through hole 15, some oil flow may be made by the flowing passage 24 and the recovering action of the piston 13 may be smoothly made. Further, instead of this flowing passage 24, as in FIG. 4B and 4C, a cut part **24*a* may be made by cutting a part of the outer periphery of the piston 13 and a gap 24*b* may be provided by making the outer periphery of the piston 13 slightly smaller than the inner periphery of the cylinder 7**.

The fitting frame for the automatic door closing device of the present invention shall be detailed in the following.

Figure 5:
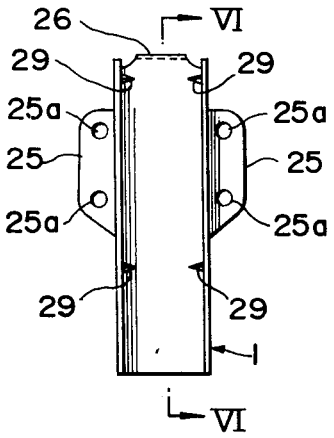
FIG. 5 is an elevation of a fitting frame.
Figure 6:
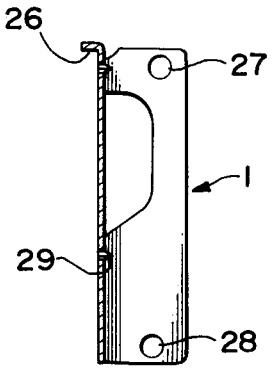
FIG. 6 is a sectioned view on line VI—VI in FIG. 5.

In the present invention, as shown in FIGS. 5 and 6, the channel-shaped fitting frame 1 is provided with fitting pieces 25 projected respectively on the right and left in the same plane of the middle piece and having respectively fitting holes 25*a* (two on each of the right and left in the drawing). This fitting piece 25 had better be made, for example, by cutting and raising a part of each piece. On the other hand, a locking piece 26 bent at right angles is provided on the side opposite both pieces at the upper end of the fitting frame 1. By the way, upper holes 27 made in both pieces are for the bearing 6 pivoting the L-lever 3 (See FIG. 2) at one end on the short piece side and lower holes 28 are for the bearing 8 pivoting the cylinder 7 (see FIG. 1) at one end. Further, as required, embossments 29 are provided (in four places in the drawing).

Figure 2:
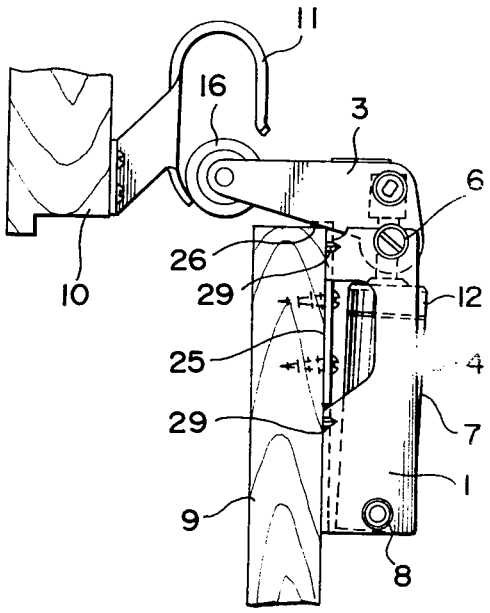
FIG. 2 is a side view of an automatic door closing device according to the present invention.

In fitting the fitting frame 1 of such formation to the door, when the locking piece 26 is hung on the upper end of the door 9 with the L-lever 3 and cylinder 7 as fitted as shown in FIG. 2, the vertical state of the automatic door closing device and the upper end of the fitting position will be determined and therefore the fitting frame may be fixed as it is with screws through the fitting holes 25*a* made in the fitting pieces 25. Needless to say, as the locking piece 26 has some clearance between the door 9 and a wall frame 10, there will be no trouble in opening and closing the door. By the way, the hook plate 11 is fitted to the end part of the wall frame 10 as fitted to the fitting frame 1 as before.

The operation of the automatic door closing device thus simply fitted through the fitting frame according to the present invention shall be explained.

When the door 2 is pushed or pulled to open in the direction indicated by the arrow from the closed door state (See FIG. 1), the L-lever 3 will rotate counterclockwise while pushing up the piston 13 against the spring 21 with its one end as an axis and the rubber roller 16 at the other end using the hook plate 11 as a guide.

In such case, the piston 13 will slide upward to compress the oil within the cylinder 7 but the ball 14 will operate downward to open the through hole 15 made in the piston 13. Therefore, the compressed oil will flow through this through hole 15, the clearance between the inner wall of the cylinder 7 and the piston 13, circulating hole 24, cut part 24*a* or air gap 24*b* and the L-lever 3 may have a force to overcome the force of only the spring 21. By the way, as the L-lever 3 is pivoted at one end on the short piece side to the fitting frame 1, it will serve as a lever and therefore the force to the rubber roller 16 will act with a force weaker than it.

When the L-lever 3 is rotated counterclockwise until the axis of the bending point passes the dead point on the straight line connecting the pivoting point 8 of the fitting frame 1 and cylinder 7 and the pivoting point 2 of the fitting frame 1 and lever 3, thereafter the L-lever will self-rotate with the force of the spring 21. However, the L-lever 3 will be locked by the fitting frame 1 to stop the rotation and will be disengaged with the hook plate 11 so that the door may be freely opened. This state is in FIG. 2.

The operation at the time of closing the door shall be explained. When the door is closed from the opened door state, the rubber roller 16 will engage with the hook plate 11 just before the closing and the L-lever 3 will be rotated clockwise. Soon after the rotation, the axis of the bending point of the L-lever passes the above described dead point and therefore the L-lever 3 will be automatically rotated by the spring 21.

In such case, the piston 13 will be moved downward and the ball 14 will close the through hole 15 but the piston 13 will move at a proper speed due to the clearance between the inner wall of the cylinder 7 and the piston, circulating hole 24, cut part 24*a* or gap 24*b*.

Thus, the locking operation will be fast at first, will become slow gradually and will become slower just before the door is completely closed and therefore the door will be locked quietly. In such case, even if an unreasonable external force is applied to the door, the door will not be closed quickly but will be locked quietly and will never make a noise. It is needless to say that the device of the present invention can be used also for sliding doors.

By the way, during the operation of the dash pot 4, the oil within the cylinder will be compressed by the upward movement of the piston 13 but the packing 14 will be strongly pressed in contact with the inner surface of the lid 12 by the spring 12, the piston shaft 5 will be always pressed on the periphery by the edge part 19*a* and therefore the oil will not flow out of the cylinder 7 through the piston shaft 5. Further, as the cylinder 7 and lid 12 are sealed with the O-ring 18, the oil will never flow out between them.

As in the above, according to the present invention, the structure is simple, the locking operation is fast, no noise is generated in locking, oil leakage can be perfectly prevented and the fitting is very simple.

I claim:

1. An automatic door closing device comprising:

(a) a hook-shaped cam plate adapted to be secured to the door frame;

(b) a vertically arranged elongated channel-shaped frame adapted to be secured to the side of a door, said frame comprising a central portion between spaced perpendicular members on opposite sides thereof, and a pair of ears extending in the plane of said central member from the sides of said respective perpendicular members opposite said central member and including holes therein for mounting said frame to the surface of said door with screws, said central member including an extension projecting perpendicularly to the plane of said central member from the top end thereof and in the opposite direction from said spaced perpendicular members and adapted to rest on the top end of the door to properly space said frame on said door with respect to the end of said door and with respect to said hook-shaped cam plate;

(c) a bell crank lever mounted at one end thereof to pivot about a first axis on said perpendicular members on said frame;

(d) a roller rotatably mounted at the opposite end of said bell crank lever and adapted to cooperate with said hook-shaped cam plate (e) a dash pot comprising a cylinder closed at one end and having a lid with an aperture therein screwed to the opposite end, a piston slidable in said cylinder, a piston shaft connected to said piston and slidably extending through said aperture in said lid, spring means biasing said piston towards said closed end of said cylinder, hydraulic fluid in said cylinder, sealing means comprising an O-ring between said cylinder and lid and a packing of channel-shaped section on the inner surface of said lid adjacent said aperture to prevent said fluid from passing between said cylinder and lid and between said lid and piston rod, check valve means in said piston permitting free flow of fluid during movement of said piston through said cylinder towards said lid and preventing flow of fluid during movement of said piston through said cylinder towards said closed end, and means for controlling the rate of flow of said fluid past said piston during movement of said piston through said cylinder;

(f) said dash pot having said closed cylinder end mounted on said perpendicular members of said frame for pivotal movement about a second axis and the free end of said piston shaft mounted on said bell crank lever for pivotal movement about a third axis, the pivot axes of said dash pot and of said bell crank lever on said perpendicular members of said frame being spaced from each other and the pivot axis of said dash pot on said bell crank lever being intermediate the pivot axis of said bell crank lever on said perpendicular members of said frame and the rotational axis of said roller such that said bell crank lever includes a short arm extending between said first and third axes and a long arm extending between said third axis and roller axis; and (g) said first, second and third pivot axes being arranged such that during pivotal movement of said bell crank lever about said first axis said bell crank lever moves through a dead center position wherein said first, second and third axes constitute a straight line;

(h) whereby when said door is opened said bell crank lever is pivoted against the pressure of said spring means by said hook-shaped cam plate through said dead center position to a position wherein said long arm extends transversely of the plane of said door over the top end of said door, and when the door is closed said bell crank lever is pivoted by said hook-shaped bell crank lever in the opposite direction past said dead center position after which said spring means continues to pivot said bell crank lever in cooperation with said hook-shaped cam plate drawing said door to a fully closed position wherein said long arm extends substantially parallel to the plane of said door beyond the top end of said door, said dash pot slowing movement of said door as it is closed.

2. An automatic door closing device according to claim 1 wherein said packing includes a conical tubular edge part projected in the direction of the piston shaft from its inner surface, the outer peripheral part of said edge part is pressed by a pressing ring against the piston shaft and said packing is pressed by said spring means against the inner surface of the lid.

3. An automatic door closing device according to claim 1 wherein said check valve means comprises an aperture through the piston in the axial direction, a ball provided in said fluid passage and a washer retaining the ball in said fluid passage.

4. An automatic door closing device according to claim 1 wherein said frame is provided with embossments.

5. An automatic door closing device according to claim 1 wherein said frame is formed by cutting and raising a part of each of a pair of side pieces on opposite sides of said central portion to form said perpendicular members.

6. An automatic door closing device according to claim 1 wherein said means for controlling the rate of flow of fluid comprises a tapered inner wall in said cylinder having such inclination angle as reduces the bore diameter downward towards said closed end of said cylinder, the minimum bore diameter of said inner wall being substantially the same as the diameter of the piston.

7. An automatic door closing device according to claim 6 wherein said tapered inner wall in said cylinder is uniformly tapered throughout the length of said cylinder.

8. An automatic door closing device according to claim 1 wherein said means for controlling the flow of fluid comprises a circulating hole of a small diameter passing through the piston.

9. An automatic door closing device according to claim 1 wherein said means for controlling the flow of fluid comprises a cut part made in a part of the outer periphery of the piston.

10. An automatic door closing device according to claim 1 wherein said means for controlling the flow of fluid comprises a gap provided between the outer periphery of the piston and the inner wall of the cylinder.

* * * * *